US005979422A

United States Patent [19]

Flierl et al.

[11] Patent Number: 5,979,422

[45] Date of Patent: Nov. 9, 1999

[54] IGNITION RAIL WITH SEALED MOVABLE CONNECTIONS

[75] Inventors: Werner Flierl, Sulzbach-Rosenberg; Herbert Laufer, Grëfenberg; Wolfgang Weltin, Nërnberg, all of Germany

[73] Assignee: TEMIC TELEFUNKEN microelectronic GmbH, Heilborn, Germany

[21] Appl. No.: 09/013,259

[22] Filed: Jan. 26, 1998

[30] Foreign Application Priority Data

Jan. 25, 1997 [DE] Germany ..... 197 02 696

[51] Int. Cl.[6] ..... F02P 3/00

[52] U.S. Cl. ..... 123/647; 123/635

[58] Field of Search ..... 123/635, 169 PA, 123/169 PH, 647, 143 C; 439/127, 125, 128

[56] References Cited

U.S. PATENT DOCUMENTS

| | | | |
|---|---|---|---|
| 4,903,675 | 2/1990 | Huntzinger et al. | 123/635 |
| 5,577,921 | 11/1996 | Philyaw et al. | 439/125 |

FOREIGN PATENT DOCUMENTS

| | | |
|---|---|---|
| 0470938A1 | 2/1992 | European Pat. Off. . |
| 0512357A2 | 11/1992 | European Pat. Off. . |
| 9002123 | 6/1990 | Germany . |
| 3920080A1 | 1/1991 | Germany . |

*Primary Examiner*—Willis R. Wolfe
*Assistant Examiner*—Mahmoud M. Gimie
*Attorney, Agent, or Firm*—Venable; George H. Spencer; Catherine M. Voorhees

[57] ABSTRACT

This invention concerns an ignition rail featuring a movable connection between the recesses of the tube portion carrier (ZT) and the connectors of the tube portions (ZR) by means of two O-rings, which connection protects against mechanical overloads and the ingress of humidity.

19 Claims, 3 Drawing Sheets

IGNITION RAIL WITH SEALED MOVABLE CONNECTIONS

BACKGROUND OF THE INVENTION

This invention concerns an ignition rail for contacting an ignition device with the spark plugs of an internal combustion engine.

When using an ignition rail, spark plugs are not contacted to the ignition current via individual ignition cables complete with connector portions but all spark plugs of a cylinder head will be contacted jointly. The ignition rail consists of a tube portion carrier in which tube portions are mounted by means of connector portions. With this type of mounting, the ignition rail is removed whenever spark plugs need to be serviced; in this way all spark plugs for a cylinder head become accessible.

Within a cavity of the tube portion carrier parts of the ignition device can be arranged, which achieves particularly short connections between spark plug and ignition device.

For instance, an ignition rail is known from printed publication U.S. Pat. No. 4,903,675 where tube portions and connector portions are designed as joint parts. Tube portions each contain a primary coil by means of which the ignition voltage is transmitted contactless to specially designed spark plugs each of which contains a secondary coil.

The problem in the use of an ignition rail are unavoidable tolerances concerning the relative distances between the spark plugs which need to be compensated by the ignition rail. The ignition rail must be protected against the ingress of humidity.

In printed publication U.S. Pat. No. 5,577,921 a connection system for the electric connection of a spark plug according to the single coil concept is proposed. Here, a separate coil is mounted in the head component of each tube portion. At the end of the tube portion a connector portion is screwed on which is designed for conventional spark plugs. Protection against the ingress of humidity is ensured by O-rings.

The disadvantage of the plug-in type device consists in the complicated design of the connector portion as well as in the specially designed cylinder head for this plug-in type device, which only allows very low production tolerances.

Printed publication DE 39 20 080 A1 also describes an ignition device according to the single coil concept, where the ignition coil for a spark plug is located in a separate housing next to the tube portion with the connector portion. With this arrangement, the tube portions with the connector portions can be pulled off individually from the spark plugs without the ignition rail—which is designed as a housing encompassing the tube portions and the connector portions—having to be removed. Mounting the tube portions with the connector portions on the ignition rail is effected by means of a plug-in device which is implemented—for instance—as a bayonet catch.

The disadvantage of this ignition device lies in its complex and cost-intensive structural setup as well as in its decidedly high space requirement.

SUMMARY OF THE INVENTION

It is an object of the invention to provide a simple structural setup for an ignition rail comprising a tube portion carrier complete with tube portions and connector portions for conventional spark plugs where the tube portions and the tube portion carrier are connected by means of a plug-in type device, such that production tolerances can be compensated and the ignition rail is protected against the ingress of humidity.

This object is achieved according to this invention by an ignition rail having a tube portion carrier with tube portions and connector portions whereby the tube portions are retained in the tube portion carrier by means of at least a first O-ring and at least a second O-ring. To this end, the tube portion carrier features a number of recesses corresponding to the number of spark plugs to be contacted. The top sections of the tube portions are each designed as connectors for a recess in the tube portion carrier. In particular, a first O-ring exactly and a second O-ring exactly are provided for.

For the first O-ring which is located at the top end of the connector portions, the recesses of the tube portion carrier have each been provided with a groove; this causes the connector of the tube portion to engage with the tube portion carrier when the connection is made. This allows the first O-ring to take up axial forces and, in addition, represents a movable connection which compensates component tolerances and seals against humidity ingress.

In a further application of the invention a groove is provided for the second O-ring which groove is located on the tube portion connector below the first O-ring. This allows the second O-ring to take up radial forces acting on the tube portions via the tube portion carrier, whilst the connection remains flexible, and, in addition, component tolerances can be compensated. Moreover, the second O-ring also provides protection against humidity ingress.

Another application of the invention provides for the recesses in the tube portion carrier, and the tube portion connectors, to be designed in the form of a bayonet catch.

An advantageous further application of the invention provides for the ignition coil of each spark plug to be accommodated in each respective tube portion, in accordance with the single coil concept.

Here, the connector portions are to be designed such that they are replaceable in order to be able to replace them in the event of wear phenomena occurring.

Another advantageous further application of the invention provides for the ignition rail to be designed such that it can receive a printed circuit board, with the ignition rail being sealed against humidity ingress. The printed circuit board can carry the electrical feed lines for the ignition coils inside the tube portions as well as, for example, a power supply unit and components of the control electronics for the ignition device.

A subsequent further application of the invention provides for the connector portion to be fitted with a device which effects a clamping of the connector portion to the spark plug, with the clamping force being adjusted such that it is easy to pull off the connector portion from the spark plugs of the internal combustion engine, as the structure of the ignition rail prevents a connector portion from becoming undone.

A final further application of the invention provides for the ignition rail to be fitted at its external ends with a lifting mechanism by means of which the ignition rail can be pulled off the spark plugs evenly and without tilting. Whilst the internal combustion engine is running the lifting mechanism will cause the ignition rail to be locked in position and stabilized.

The structural setup—according to the invention—of the ignition rail complete with the first and the second O-ring, significantly improves the suitability for everyday use and the reliability of the ignition rail.

BRIEF DESCRIPTION OF THE DRAWINGS

Further details of the ignition rail according to the invention are provided by the following description of a preferred embodiment example, using the three drawings attached.

The figures show.

DESCRIPTION OF A PREFERRED EMBODIMENT

Figure 3:
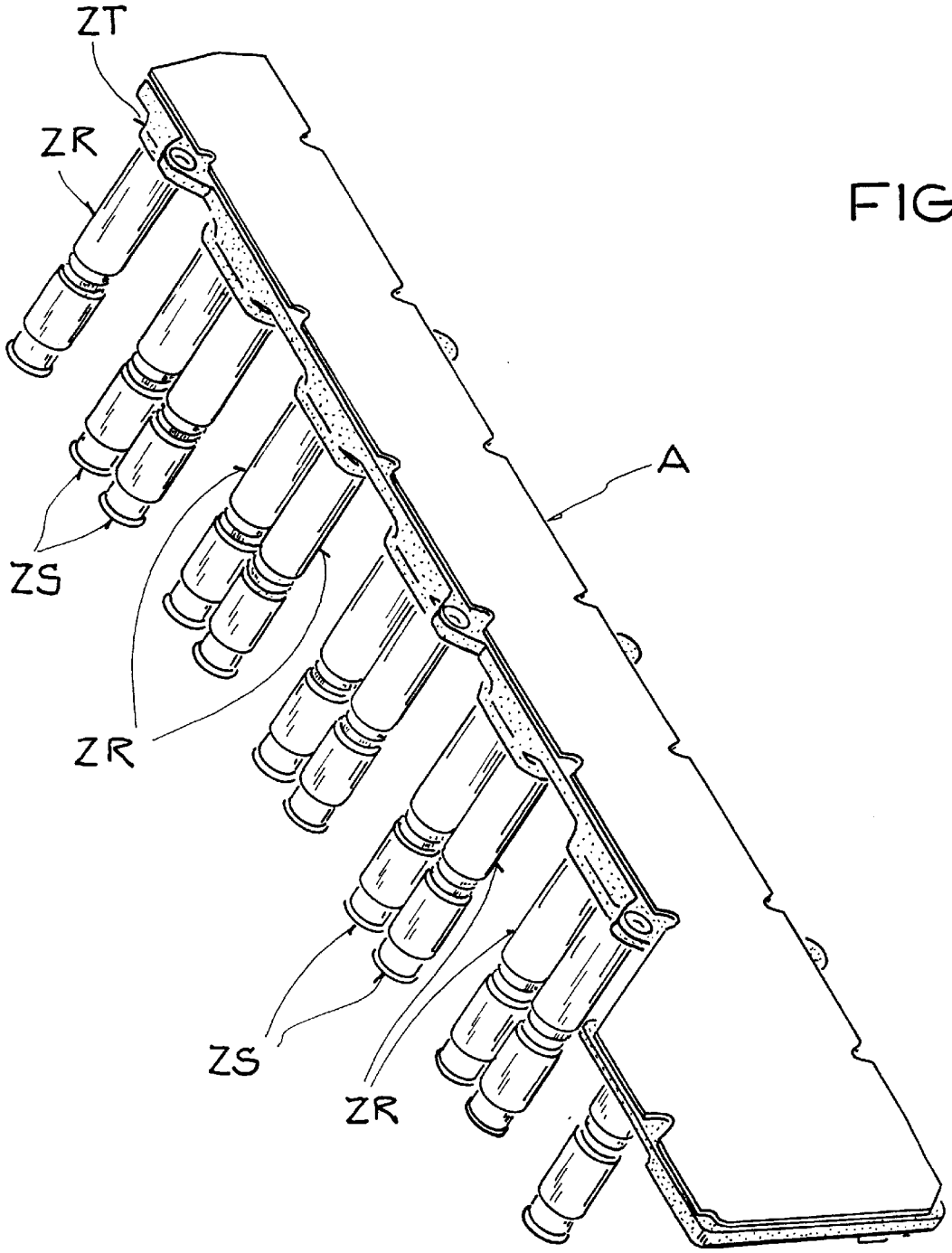

FIG. 3 shows a complete illustration of the ignition rail in a three-dimensional diagrammatic view. For ignition devices in accordance with the single coil concept, each spark plug of an internal combustion engine is supplied by its own ignition coil with the high voltage required for the ignition process.

Here, the ignition coil can be located close to the spark plug directly following the connector portion ZS in the tube portion ZR. With such an arrangement, it is meaningful to cluster tube portions ZR located next to each other by means of a common ignition rail; all necessary electrical feed lines can also be routed through this ignition rail.

The single coil concept in connection with an ignition rail proves to be particularly meaningful when combining the ignition device with an advanced engine management system. For instance, such an advanced engine management system can comprise an ion current measurement device for the detection of engine knocking, or an energy control system for the ignition sparks during an ignition process. A characteristic of the single coil concept is utilized here, namely that high voltage components are solely located within the tube portions ZR, whilst the ignition rail only comprises low voltage components. This allows electronic components of the ignition device to be located in the tube portion carrier ZT, which results in a considerable shortening of cable lengths and data paths and allows the structural setup of the ignition device to be implemented in a very compact format.

The 12-cylinder in-line engine by Mercedes Benz is equipped with an engine management system of this type. The engine—which is fitted in a longitudinal direction—is ignited by means of two spark plugs on each cylinder; this results in respective ignition rails being fitted symmetrically on the left-hand and right-hand side of the cylinder block; such an ignition rail comprises a tube portion carrier ZT complete with 12 tube portions ZR and 12 connector portions ZS. In order to receive a printed circuit board the tube portion carriers ZT are designed to be hollow and are each fitted with a cover A. Each printed circuit board integrates control electronics components for the engine management system as well as a power supply unit. Sealing against humidity ingress is effected at the top of both tube portion carriers ZT by means of circumferential sealing material which is pressed by cover A—using bolts—against the edge of the tube portion carrier ZT.

The sealing on the underside of the tube portion carrier ZT, with recesses for the connectors of the tube portions ZR, must meet additional requirements. In addition to being sealed against humidity ingress, the connection must be flexible or movable as the spark plugs are arranged in the engine block with a finite degree of accuracy only.

Moreover, an ignition rail cannot be pulled off absolutely vertically from the spark plugs; this means that the tube portions ZR within the tube portion carrier ZT must have some play so as not to be damaged when being pulled off.

Figure 1:
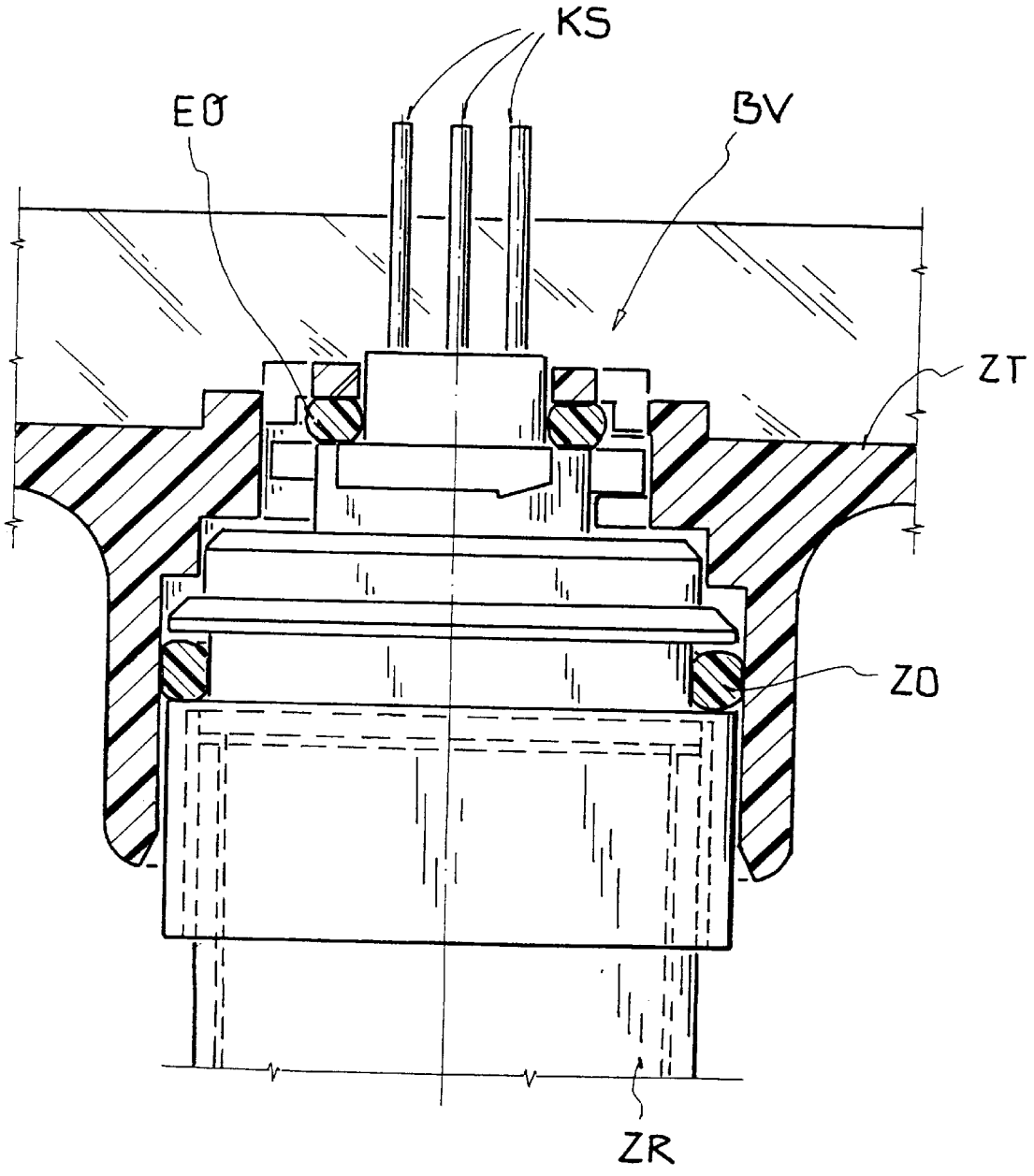
FIG. 1 a schematic diagram showing a cross-section through the connector of a tube portion and the recess on the tube portion carrier.

FIG. 1 shows a cross-section through the connector of a tube portion. The tops of tube portions ZR which are facing tube portion carrier ZT are formed into a connector which features a first O-ring EO and a second O-ring ZO. The first O-ring EO at the external end of the plug sits on a cylindrical part of the connector which widens in a downward direction by at least the thickness of the O-ring such that the first O-ring EO cannot be displaced when connecting the tube portion ZR with tube portion carrier ZT. The edge of the recesses on tube portion carrier ZT is provided with a groove for the first O-ring EO into which groove this first O-ring EO slides when connection is made. Furthermore, the recesses on tube portion carriers ZT and the connectors of the tube portions ZR are designed such that, respectively, they form a bayonet catch BV.

Figure 2A:
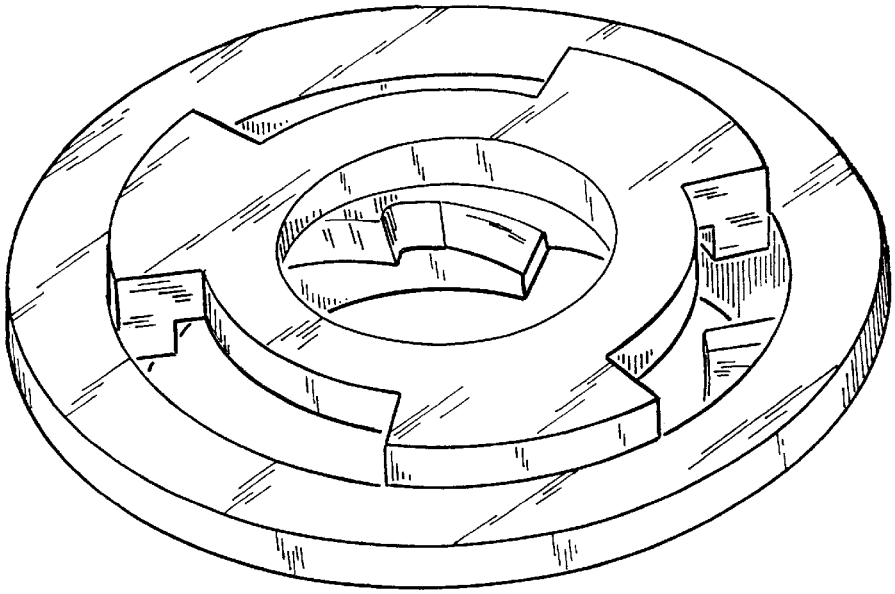
FIG. 2 a three-dimensional illustration of the bayonet catch
where a) represents the top, and b) the bottom
of the bayonet catch FIG. 3 a three-dimensional representation of the ignition rail.
Figure 2B:
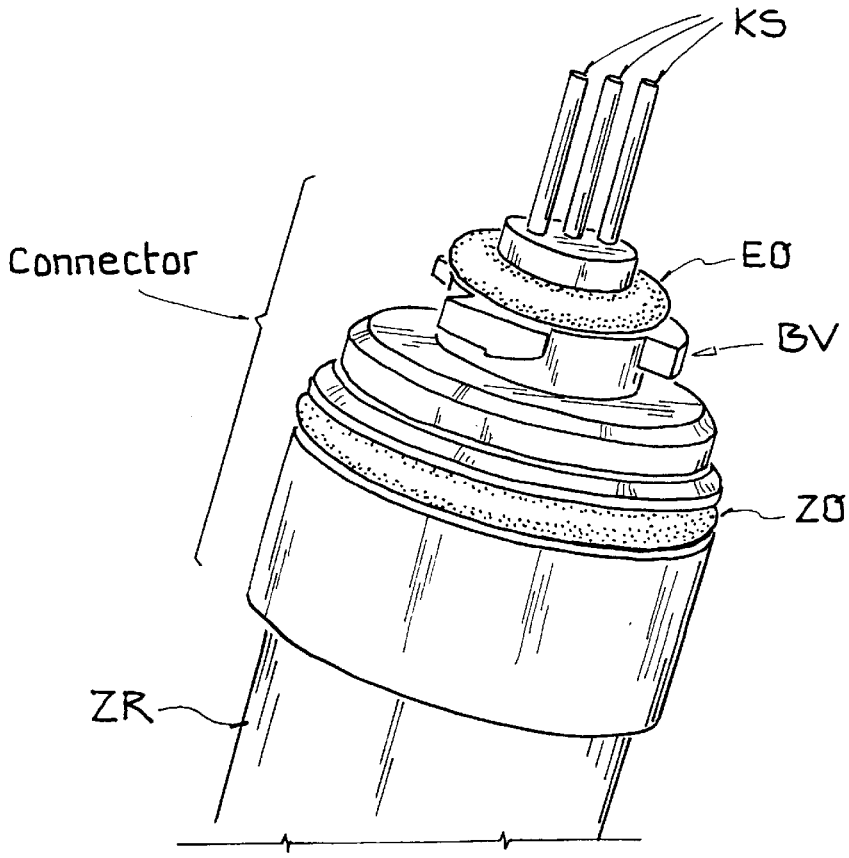

FIG. 2 shows a three-dimensional view of such a bayonet catch, with FIG. 2*a* showing the top part of the bayonet catch—which part is fitted in the recess on the tube portion carrier—; and FIG. 2*b* shows how the bottom of the bayonet catch is formed on the connector of the tube portion. When making the connection, the connector of a tube portion ZR is inserted into a recess of the tube portion carrier ZT by means of a rotary movement; the top and bottom parts of the bayonet catch will then engage and lock each other in position. Here, the first O-ring EO will be pressed lightly into the groove, thus achieving limited movability and a tolerance compensation effect, and by means of which the first O-ring EO can compensate axial forces acting on the tube portion ZR, i.e. pull or pressure.

The second O-ring ZO is located below the first O-ring EO within a groove on the tube portion ZR. After connecting the tube portion ZR with the tube portion carrier ZT, the second O-ring ZO can support itself against the wall of the recess on tube portion carrier ZT in the event of radial forces occurring which act on the tube portion ZR; this results in tube portion ZR being slightly movable against tube portion carrier ZT and ensures that the ignition rail remains sealed against humidity ingress.

The contact pins KS which connect the ignition coil within the tube portion ZR to the printed circuit board within the tube portion carrier ZT are arranged such in the tube portion ZR that, after the tube portions ZR have been connected with the tube portion carrier ZT, the printed circuit board comprising the contact apertures for the contact pins KS can be placed over the contact pins KS of the ignition coils.

The connector portions ZS, which form the bottom of tube portion ZR, are removably attached to tube portion ZR in order to allow easy replacement in the event of signs of wear occurring.

The connector portions ZS are provided with a device which effects a clamping of the connector portion ZS to the ignition rail. Here, the clamping force—which the connector portions ZS need to exert in order to ensure a secure seating on the spark plugs—is significantly reduced, compared with conventional connector portions, as any unintentional undoing of the connector portions ZS, caused by engine vibrations for instance, is not possible due to the rigid structural setup of the ignition rails.

In order to allow ignition rails to be pulled off from the spark plugs particularly evenly, there is the option of providing a pull-off mechanism at the ends of the ignition rail;

this pull-off mechanism features a lever which when operated causes metal pins to be pressed against the engine block of the internal combustion engine; this causes all connector portions on an ignition rail to be pulled off evenly from the spark plugs.

Connecting tube portions ZR with tube portion carrier ZT, via a first O-ring EO and a second O-ring ZO, significantly increases the suitability of such ignition rails for everyday use, as any unintentional tilting of the tube portions ZR with the spark plugs cannot so easily cause damage to the tube portions ZR. And with such an arrangement, the electrical components of the ignition device located in the tube portions ZR and within the tube portion carrier ZT will remain protected against the ingress of humidity.

What is claimed is:

1. Ignition rail for contacting an ignition device for internal combustion engines with spark plugs, complete with a tube portion carrier (ZT) which features a number of recesses corresponding to the number of spark plugs to be contacted, and complete with tube portions (ZR) whose top sections are each designed as a connector for one of the recesses in the tube portion carrier (ZT) and whose bottom sections each feature a connector portion (ZS) for connection with a spark plug, wherein each tube portion (ZR) is retained at the connector by at least a first O-ring (EO), which is located at the external end of the tube portion connector, designed for taking up axial forces, and sits in a groove located on the edge of the recesses on the tube portion carrier (ZT), when connection is made between the connector of the tube portion (ZR) and one of the recesses on the tube portion carrier (ZT), and wherein each tube portion (ZR) is retained by at least a second O-ring (ZO) which is located in a groove on the tube portion carrier (ZT).

2. Ignition rail according to claim 1 wherein the at least one second O-ring (ZO) is located in a groove on the connector of the tube portion (ZR) below the at least one first O-ring (EO) for the take-up of radial forces and to provide protection against humidity ingress.

3. Ignition rail according to claim 1, wherein, respectively, a recess of the tube portion carrier (ZT) and a connector of the tube portions (ZR) each form a bayonet catch (BV).

4. Ignition rail according to claim 1, wherein, respectively an igition coil is located in each tube portion (ZR).

5. Ignition rail according to claim 1, wherein connector portions (ZS) are replaceable.

6. Ignition rail according to claim 1, wherein the ignition rail is designed to receive a printed circuit board, with the ignition rail being sealed against the ingress of humidity.

7. Ignition rail according to claim 1, wherein the connector portions (ZS) are fitted with a device which effects a clamping of the connector portion (ZS) to the spark plug, with the clamping force being adjusted such that it is easy to pull off the connector portions (ZS) from the spark plugs on the internal combustion engine.

8. Ignition rail according to claim 1, wherein the ignition rail is fitted with a lifting mechanism at its external ends, by means of which the ignition rail can be pulled off the spark plugs.

9. An ignition rail for contacting an ignition device for an internal combustion engine with spark plugs, comprising;

a tube portion carrier having a plurality of recesses corresponding to a number of spark plugs to be contacted, each of said recesses having an edge;

a plurality of tube portions each having a top and a bottom section, each of said top sections forming a connector for one of the plurality of recesses in said tube portion carrier and each of said bottom sections having a connector portion for receiving a spark plug, said tube portion further having an external end and an internal end;

a first O-ring, for compensating for axial forces, fitted on said external end of each said tube portion, said first O-ring sitting in a first groove formed on an edge of one of the plurality of recesses of said tube portion carrier, when the connector of said tube portion is connected to said tube portion carrier so that the tube portion is retained at the connector; and a second O-ring fitted on said internal end of said tube portion, said second O-ring sitting in a second groove formed by and between said tube portion carrier and said tube portion, when said tube portion is connected to said tube portion carrier.

10. The ignition rail according to claim 9, wherein said second groove into which said second O-ring is fitted is below said first O-ring thereby compensating for radial forces and protecting against humidity.

11. The ignition rail according to claim 9, wherein a recess of the tube portion carrier and said tube portion together form a bayonet catch.

12. The ignition rail according to claim 9, wherein with each tube portion having an ignition coil.

13. The ignition rail according to claim 9, wherein said connector portions are replaceable.

14. The ignition rail according to claim 9, further comprising a printed circuit board fitted into said ignition rail and wherein said ignition rail is sealed against the ingress of humidity.

15. The ignition rail according to claim 9, wherein said connector portions are fitted with a device which effects a clamping of the connector portion to a spark plug, with a clamping force being adjusted such that it is easy to pull off the connector portions from the spark plugs.

16. The ignition rail according to claim 9, wherein said ignition rail has external ends, said external ends being fitted with a lifting mechanism, thereby providing easy detachment of said ignition rail from said spark plugs.

17. The ignition rail according to claim 9 further comprising an ignition rail cover, said tube portion carrier being attached to said ignition rail cover.

18. The ignition rail according to claim 12, wherein said ignition rail cover receives a printed circuit board for carrying electrical feed lines for the ignition coils inside each said tube portion.

19. The ignition rail according to claim 18, wherein said printed circuit board further comprises a power supply unit and components of control electronics.

* * * * *